US008171706B2

(12) United States Patent
Chiu

(10) Patent No.: US 8,171,706 B2
(45) Date of Patent: May 8, 2012

(54) WRAPPING MACHINE

(76) Inventor: Chin-Tzu Chiu, Taichung (TW)

( * ) Notice: Subject to any disclaimer, the term of this patent is extended or adjusted under 35 U.S.C. 154(b) by 229 days.

(21) Appl. No.: 12/610,323

(22) Filed: Nov. 1, 2009

(65) Prior Publication Data

US 2011/0099943 A1 May 5, 2011

(51) Int. Cl.
*B65B 11/52* (2006.01)

(52) U.S. Cl. ..... 53/509; 53/427

(58) Field of Classification Search ..... 53/411, 53/442, 464, 52, 509, 131.1, 135.1, 557, 53/203, 209, 210, 427; 156/382, 483; 425/504, 425/508, 388
See application file for complete search history.

(56) References Cited

U.S. PATENT DOCUMENTS 4,099,902 A * 7/1978 Oberloier ..... 425/388
4,164,109 A * 8/1979 Dubois ..... 53/427
4,598,527 A * 7/1986 Hollingsworth et al. ..... 53/427
5,072,574 A * 12/1991 Puett ..... 53/427
6,755,012 B2 * 6/2004 Frankefort ..... 53/557
2005/0150188 A1 * 7/2005 Stork et al. ..... 53/442

* cited by examiner

*Primary Examiner* — Paul Durand

(74) *Attorney, Agent, or Firm* — Pai Patent & Trademark Law Firm; Chao-Chang David Pai

(57) ABSTRACT

A wrapping machine has a body, a heater, a lifting platform and a controller. The body has a base, a top board, an upper cover, an exhaust box and a vacuum pump. The top board is detachably mounted on the top of the base. The upper cover is pivotally connected to the base. The heater is mounted in the body and has at least one heating pipe and a blower. The at least one heating pipe is mounted in the upper cover. The blower is mounted on the upper cover. The lifting platform is connected to the body and has a lifting arm and a lifting board. The lifting arm is mounted on and extends upward from the exhaust box. The lifting board is mounted on the lifting arm. The controller is mounted on the body.

5 Claims, 7 Drawing Sheets

WRAPPING MACHINE

BACKGROUND OF THE INVENTION

1. Field of the Invention

The present invention relates to a wrapping machine, and more particularly to a wrapping machine that can wrap an object quickly and provides a preferred wrapping quality.

2. Description of Related Art

Consumer electronics, such as cell phones, televisions and computers and the like have become increasingly ubiquitous in modern society. In order to protect consumer electronics from damage or to provide a color pattern effect, a protective film is covered around the external surfaces of the consumer electronics after these products have been manufactured.

The conventional method of wrapping a consumer electronic product has steps of: cleaning external surfaces of the consumer electronic product, cutting an elongated part from an edge of the protective film, cutting the residual protective film into a size corresponding to, but larger than that of the consumer electronic product, attaching the cutting protective film onto a corresponding surface of the consumer electronic product and pressing to remove air bubbles formed between the surface of the cell phone and the protective film. When the protective film has been wrapped on the corresponding surface of the cell phone, the protective film is heated and a redundant portion of the protective film protruding beyond the corresponding surface of the cell phone is removed. Then, another protective film is wrapped on a next corresponding surface of the cell phone per the foregoing processes. Finally, an elongated part is attached around the surfaces of the consumer electronic product.

Although the conventional wrapping method can wrap the protective film around an object to provide a protect effect to an object, the protective film is manually wrapped on the object and this is time-consuming and inconvenient. In addition, the wrapping quality is depended on the skill of the operator so wrapping quality is unreliable.

To overcome the shortcomings, the present invention tends to provide a wrapping machine to mitigate or obviate the aforementioned problems.

SUMMARY OF THE INVENTION

The main objective of the present invention is to provide a wrapping machine that can wrap an object quickly and provides a preferred wrapping quality.

The wrapping machine in accordance with the present invention has a body, a heater, a lifting platform and a controller. The body has a base, a top board, an upper cover, an exhaust box and a vacuum pump. The top board is detachably mounted on the top of the base. The upper cover is pivotally connected to the base. The heater is mounted in the body and has at least one heating pipe and a blower. The at least one heating pipe is mounted in the upper cover. The blower is mounted on the upper cover. The lifting platform is connected to the body and has a lifting arm and a lifting board. The lifting arm is mounted on and extended upward the exhaust box. The lifting board is mounted on the lifting arm. The controller is mounted on the body.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
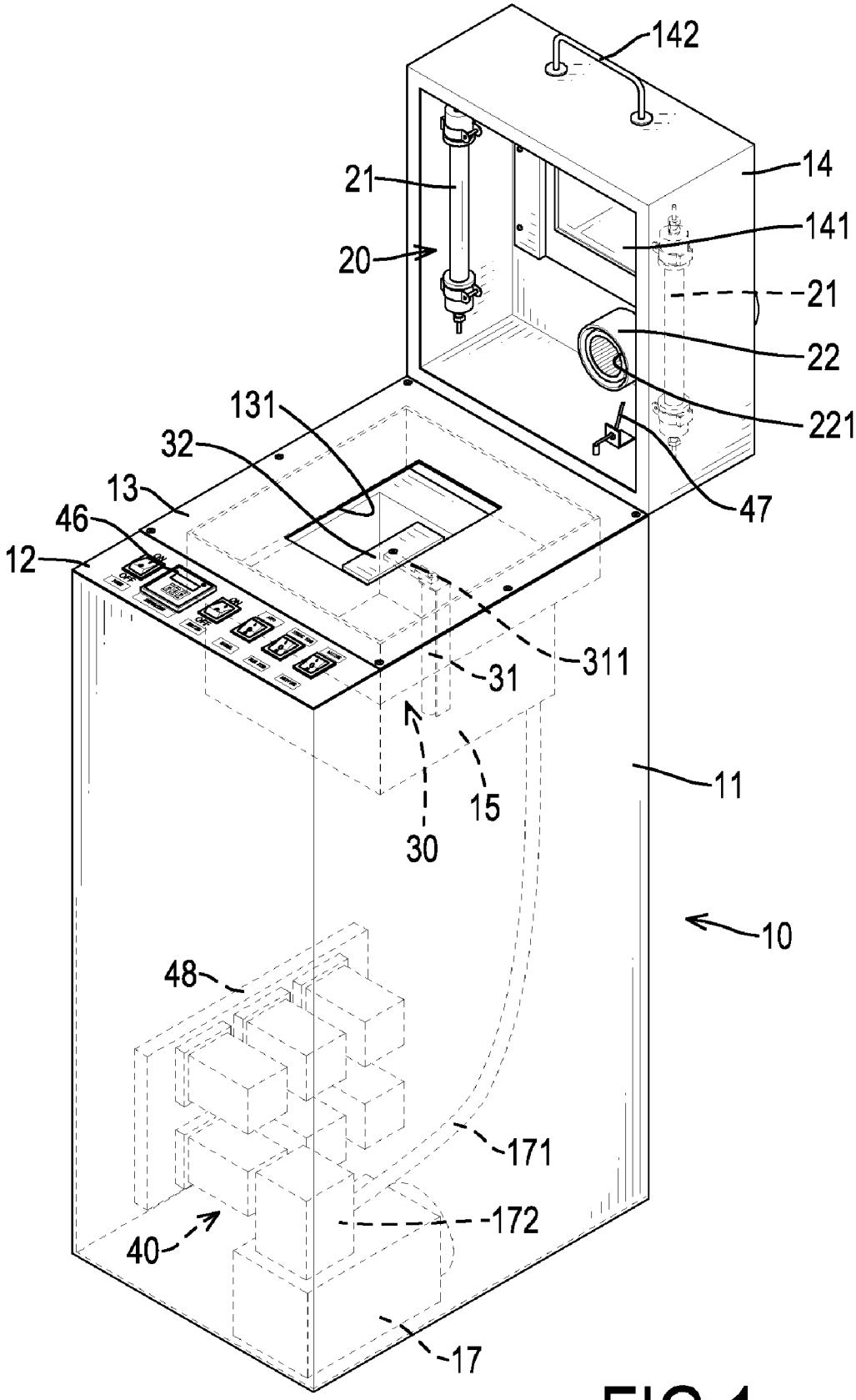
FIG. 1 is a perspective view of a first embodiment of a wrapping machine in accordance with the present invention.

With reference to FIGS. 1 to 3 and 7, a wrapping machine in accordance with the present invention comprises a body (10), a heater (20), a lifting platform (30) and a controller (40).

The body (10) has a base (11), a top board (13, 13A), an upper cover (14), an exhaust box (15) and a vacuum pump (17).

The base (11) is hollow and has a top, a bottom, a front side, a rear side, two sidewalls, an opening, a chamber and an operating panel (12). The opening is formed through the top of the base (11). The chamber is formed in the base (11) between the front and rear sides and the sidewalls of the base (11) and communicates with the opening. The operating panel (12) is mounted on the top of the base (11) near the front side.

The top board (13, 13A) is detachably mounted on the top of the base (11) between the operating panel (12) and the rear side of the base (11) and has a wrapping hole (131, 131A). The wrapping hole (131, 131A) may be rectangular, is formed through the top board (13, 13A) and communicates with the opening and the chamber of the base (11).

The upper cover (14) is pivotally connected to the top at the rear side of the base (11), is mounted on the top board (13, 13A) and has a top face, multiple sidewalls, a window (141) and a handle (142). The sidewalls of the upper cover (14) are formed around the top face of the upper cover (14) and each sidewall has an inner surface and an outer surface. The window (141) is formed through the top face of the upper cover (14) and is aligned with the top board (13, 13A). The handle (142) is mounted on the outer surface of one of the sidewalls of the upper cover (14), may be mounted on the sidewall of the upper cover (14) corresponding to the operating panel (12) of the body (10).

The exhaust box (15) is mounted in the chamber of the base (11) below the top board (13, 13A) and has an open top and a closed bottom. The open top of the exhaust box (15) is mounted around the wrapping hole (131, 131A) of the top board (13, 13A).

The vacuum pump (17) is mounted in the chamber of the base (11) and has a suction pipe (171) and a control valve (172). The suction pipe (171) is connected to the closed bottom of the exhaust box (15) and communicates with the chamber of the exhaust box (15). The control valve (172) is connected to the suction pipe (171) to control a suction of the vacuum pump (17).

The heater (20) is mounted on the body (10) and has at least one heating pipe (21) and a blower (22). The at least one heating pipe (21) may be quartz tube and is mounted on the inner surface of at least one of the sidewalls of the upper cover (14). Preferably, the heater (20) has two heating pipes (21) respectively mounted on opposite inner surfaces of the upper cover (14).

The blower (22) is mounted on the upper cover (14) and has a top end, a lower end and an air outlet (221). The top end of the blower (22) is mounted on the top face of the upper cover (14) between the sidewalls of the upper cover (14). The lower end of the blower (22) is mounted in the upper cover (14) between the sidewalls above the top board (13, 13A). The air outlet (221) is formed in the lower end of the blower (22).

Figure 4:
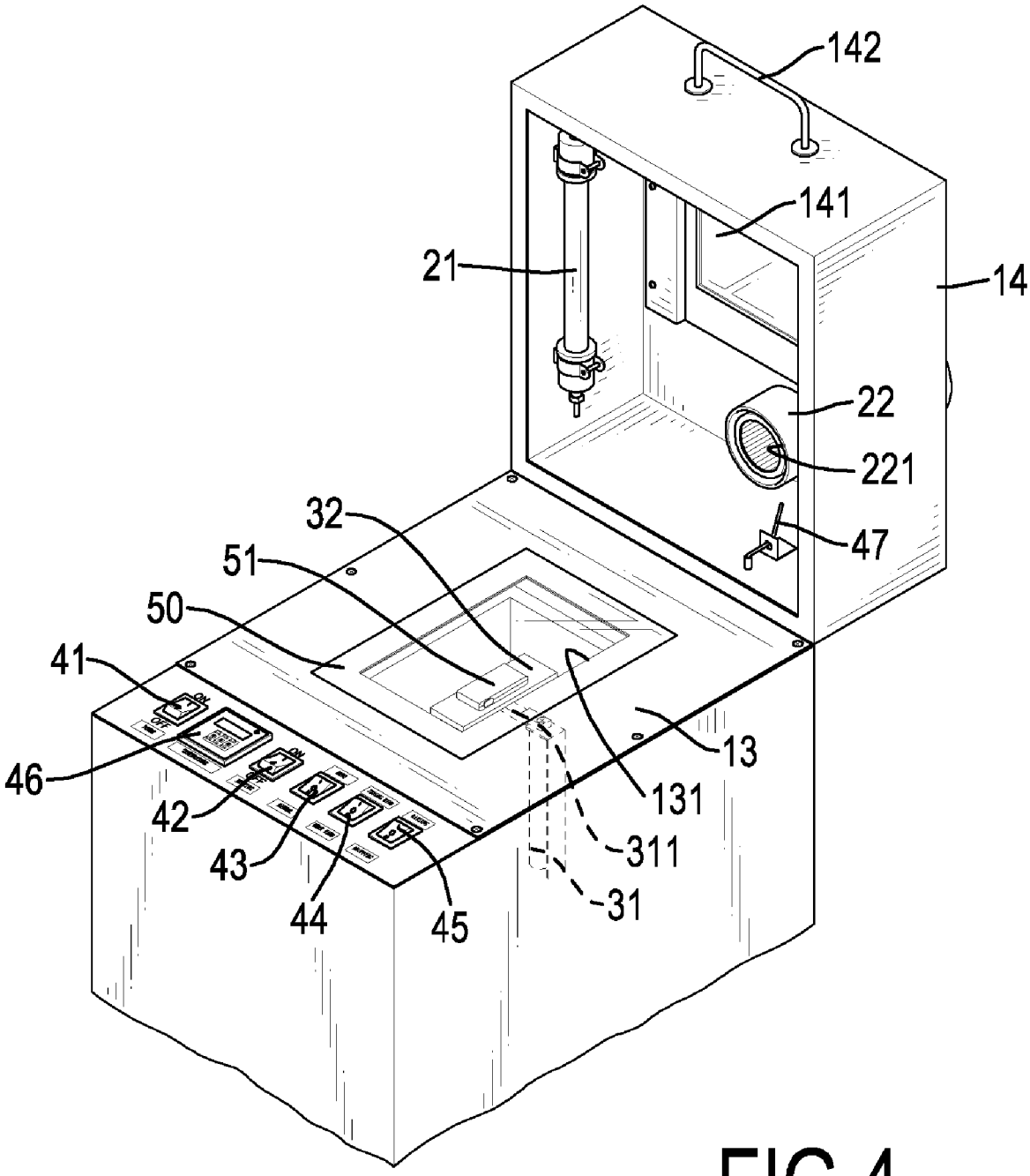
FIG. 4 is an enlarged operational perspective view of the wrapping machine in FIG. 1.
Figure 5:
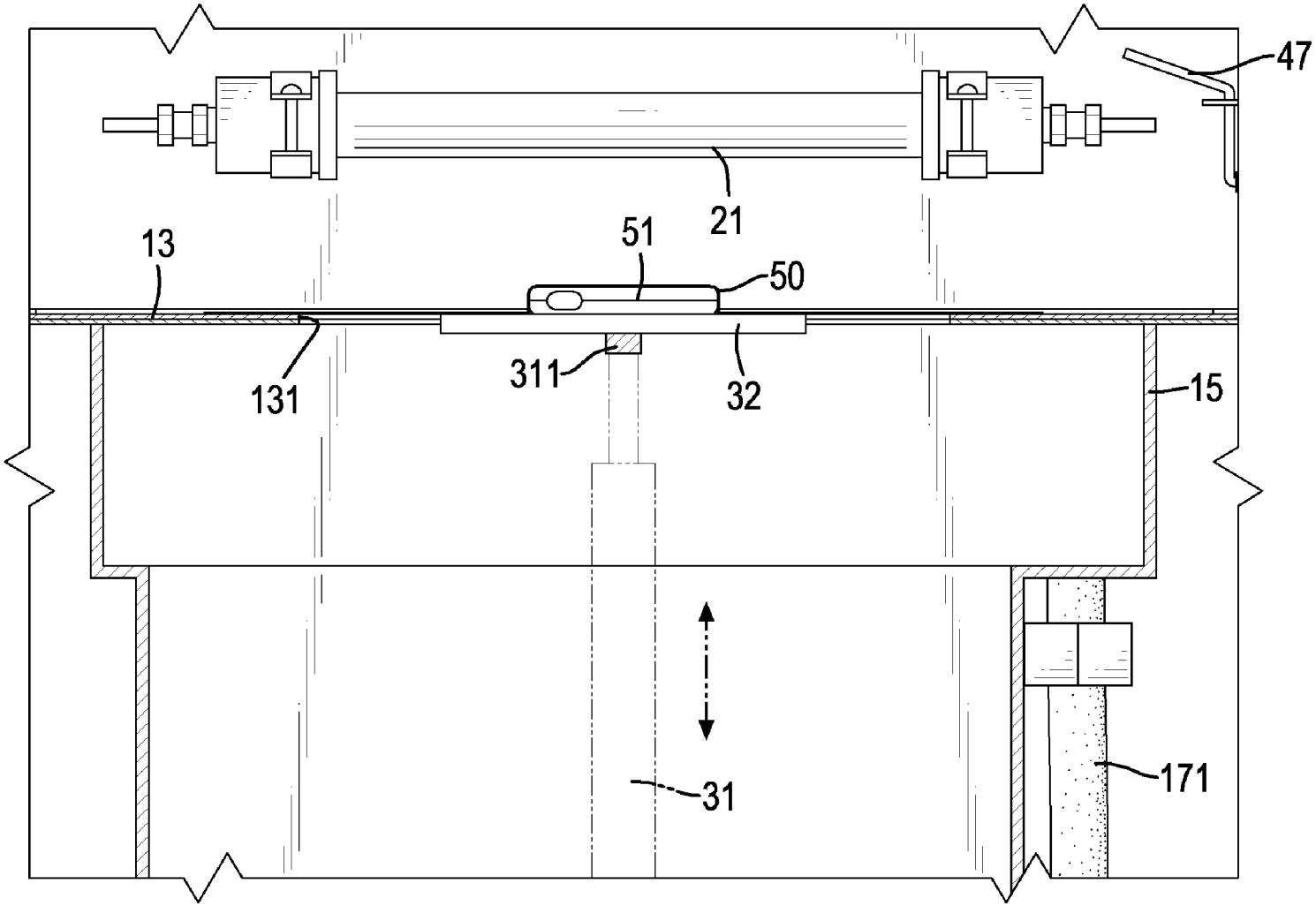
FIG. 5 is an enlarged operational side view of the wrapping machine in FIG. 1.

With reference to FIGS. 4 and 5, the lifting platform (30) is connected to the body (10) and has a lifting arm (31) and a lifting board (32). The lifting arm (31) may be a pneumatic cylinder, is mounted on the closed bottom of the exhaust box (15), is extended upward to the open top of the exhaust box (15) and has a lifting shaft and a linking panel (311). The lifting shaft is movably mounted in the lifting arm (31) and has a top end. The linking panel (311) is connected to the top end of the lifting shaft of the lifting arm (31), is extended to the wrapping hole (131, 131A) of the top board (13, 13A) and has a top face. The lifting board (32) is mounted on the top face of the linking panel (311) of the lifting arm (31) and is selectively lifted into the wrapping hole (131, 131A) of the top board (13, 13A).

Figure 3:
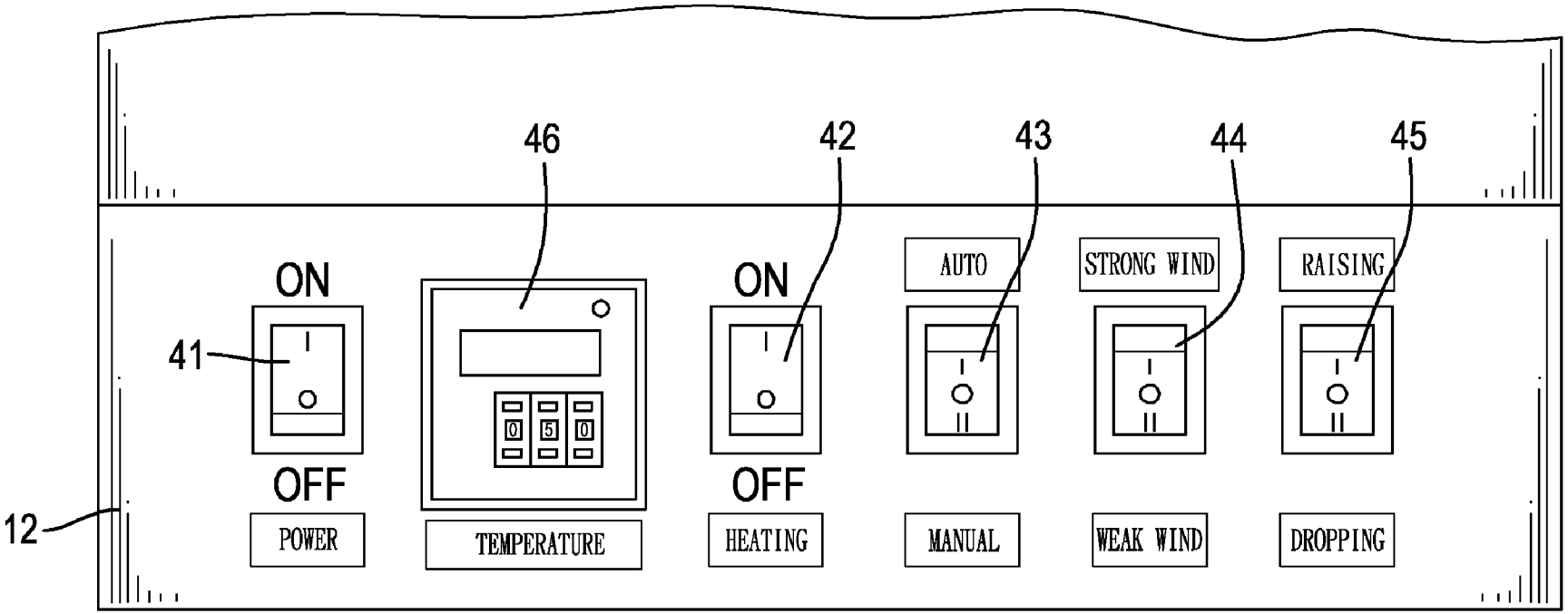
FIG. 3 is an enlarged top view of the wrapping machine in FIG. 1.
Figure 6:
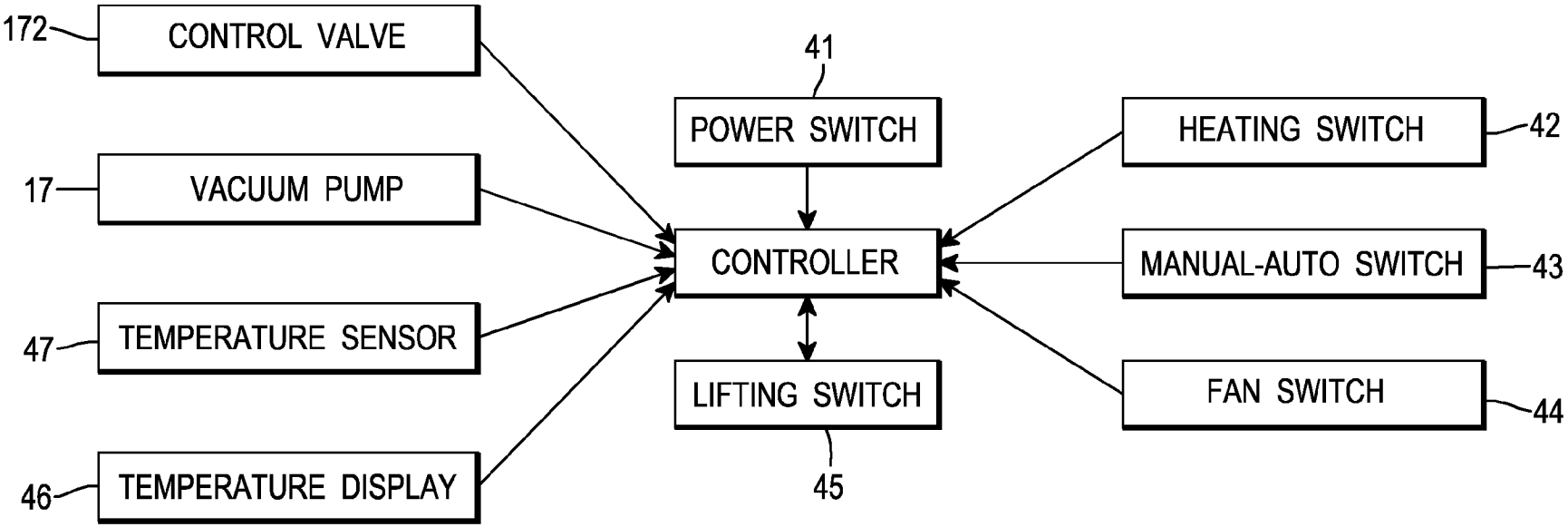
FIG. 6 is a block diagram of the wrapping machine in FIG. 1.

With reference to FIGS. 3 and 6, the controller (40) is mounted on the body (10) and has a power switch (41), a heating switch (42), a manual-auto switch (43), a blower switch (44), a lifting switch (45), a temperature display (46), a temperature sensor (47) and a controller unit (48).

The power switch (41) is mounted on the operating panel (12) of the body (10) to control electric power to the body (10), the heater (20) and the lifting platform (30). The heating switch (42) is mounted on the operating panel (12) of the body (10) adjacent to the power switch (41) to control the at least one heating pipe (21) of the heater (20). The manual-auto switch (43) is mounted on the operating panel (12) of the body (10) adjacent to the heating switch (42). The blower switch (44) is mounted on the operating panel (12) of the body (10) adjacent to the manual-auto switch (43) to control the blower (22) of the heater (20). The lifting switch (45) is mounted on the operating panel (12) of the body (10) adjacent to the blower switch (44) to control the lifting arm (31) of the lifting platform (30).

The temperature display (46) is mounted on the operating panel (12) of the body (10) between the power switch (41) and the heating switch (42) to show the temperature between the upper cover (14) and the top board (13, 13A). The temperature sensor (47) is mounted on the inner surface of one of the sidewalls of the upper cover (14) to detect the temperature between the upper cover (14) and the top board (13, 13A). The controller unit (48) is mounted in the chamber of the body (10) and is electrically connected to the vacuum pump (17), the control valve (172), the power switch (41), the heating switch (42), the manual-auto switch (43), the blower switch (44), the lifting switch (45), the temperature display (46) and the temperature sensor (47).

Figure 2:
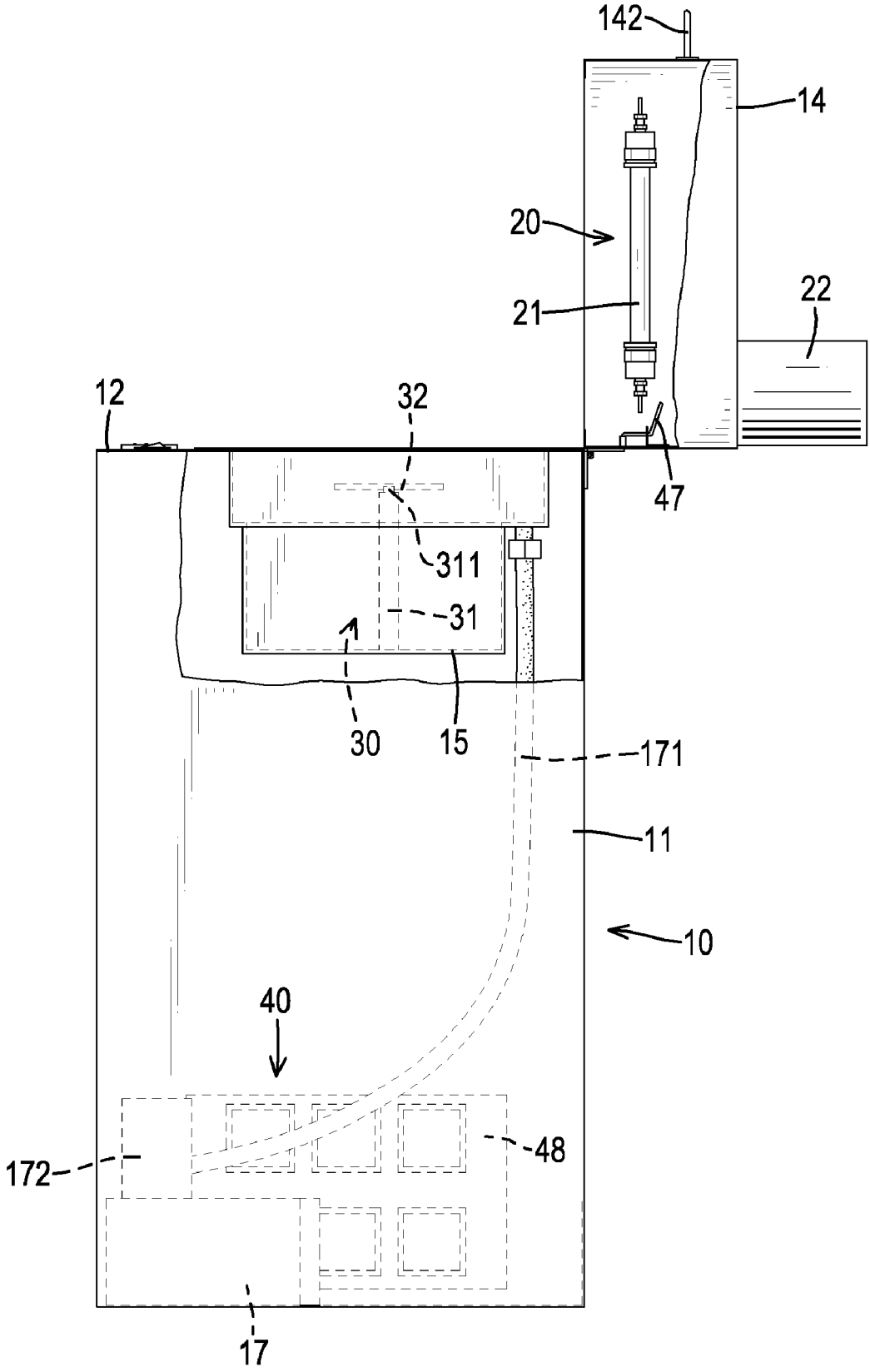
FIG. 2 is a side view in partial section of the wrapping machine in FIG. 1.

With reference to FIG. 4, when wrapping a protective film (50) on a consumer electronic product (51) using the wrapping machine of the present invention, the consumer electronic product (51) is placed on the lifting board (32) and the protective film (32) is put on the top board (13, 13A) around the wrapping hole (131, 131A) above the consumer electronic product (51). The power switch (41) and the heating switch (42) are actuated in sequence, and the upper cover (14) covers the top board (13, 13A) to close the wrapping hole (131, 131A). With reference to FIGS. 2 to 4, the air in the exhaust box (15) is drawn out by the vacuum pump (17) via the suction pipe (171) to hold the exhaust box (15) at a negative pressure and the suction of the vacuum pump (17) can be adjusted by the control valve (172) with the blower switch (44). The protective film (50) is placed between the upper cover (14) and the top board (13, 13A) is heated by the at least one heating pipe (21) in the upper cover (14) once the heating switch (42) is actuated. The protective film (50) can be evenly heated by an air flow in the space between the top board (13,13A) and the upper cover (14) driven by the blower (22). During heating, the temperature sensor (47) detects a temperature between the upper cover (14) and the top board (13, 13A), which may be shown on the temperature display (46).

In the present invention, the wrapping machine of the present invention can be operated by an auto-wrapping method or a manual wrapping method to wrap the protective film (50) on the consumer electronic product (51).

With further reference to FIG. 5, in the auto-wrapping method, the manual-auto switch (43) is switched to an auto mode, the consumer electronic product (51) is placed on the lifting board (32) with the protective film (50) on the top board (13, 13A), the upper cover (14) is closed and the controller (40) actuates the vacuum pump (17). When the exhaust box (15) is at a negative pressure the lifting board (32) is actuated by the controller (40) to move the consumer electronic product (51) relative to the protective film (50) so wrapping the protective film (50) on the consumer electronic product (51) to prevent air bubbles from forming between the consumer electronic product (51) and the protective film (50).

After wrapping the protective film (50) on the consumer electronic product (51), the upper cover (14) is opened and after cooling an excess of the protective film (50) greater than the size of the consumer electronic product (51) is cut. The consumer electronic product (51) is then turned over and put on the lifting board (32), and a new protective film (50) is put on the top board (31,31A). Accordingly, the new protective film (50) can be wrapped onto the consumer electronic product (51) by the above-mentioned operating processes. When the surfaces of the consumer electronic product (51) are wrapped with the protective films (50) by the wrapping machine in accordance with the present invention, an elongated part cut from the protective film (50) may be attached around the side of the consumer electronic product (51). Thus, the consumer electronic product (51) is wrapped completely.

In the manual method, the manual-auto switch (43) is switched to a manual mode, the consumer electronic product (51) is placed on the lifting board (32) with the protective film (50) on the top board (13, 13A), and the switches (44, 45) are manually actuated per the auto-wrapping method. In the manual-condition, the lifting switch (45) can be used to adjust the position of the consumer electronic product (51) relative to the protective film (50). Therefore, consumer electronic products with special outward appearance can be wrapped by controlling the lifting switch (45) to move the consumer electronic product (51) on the lifting board (32) to provide a preferred wrapped quality.

Figure 7:
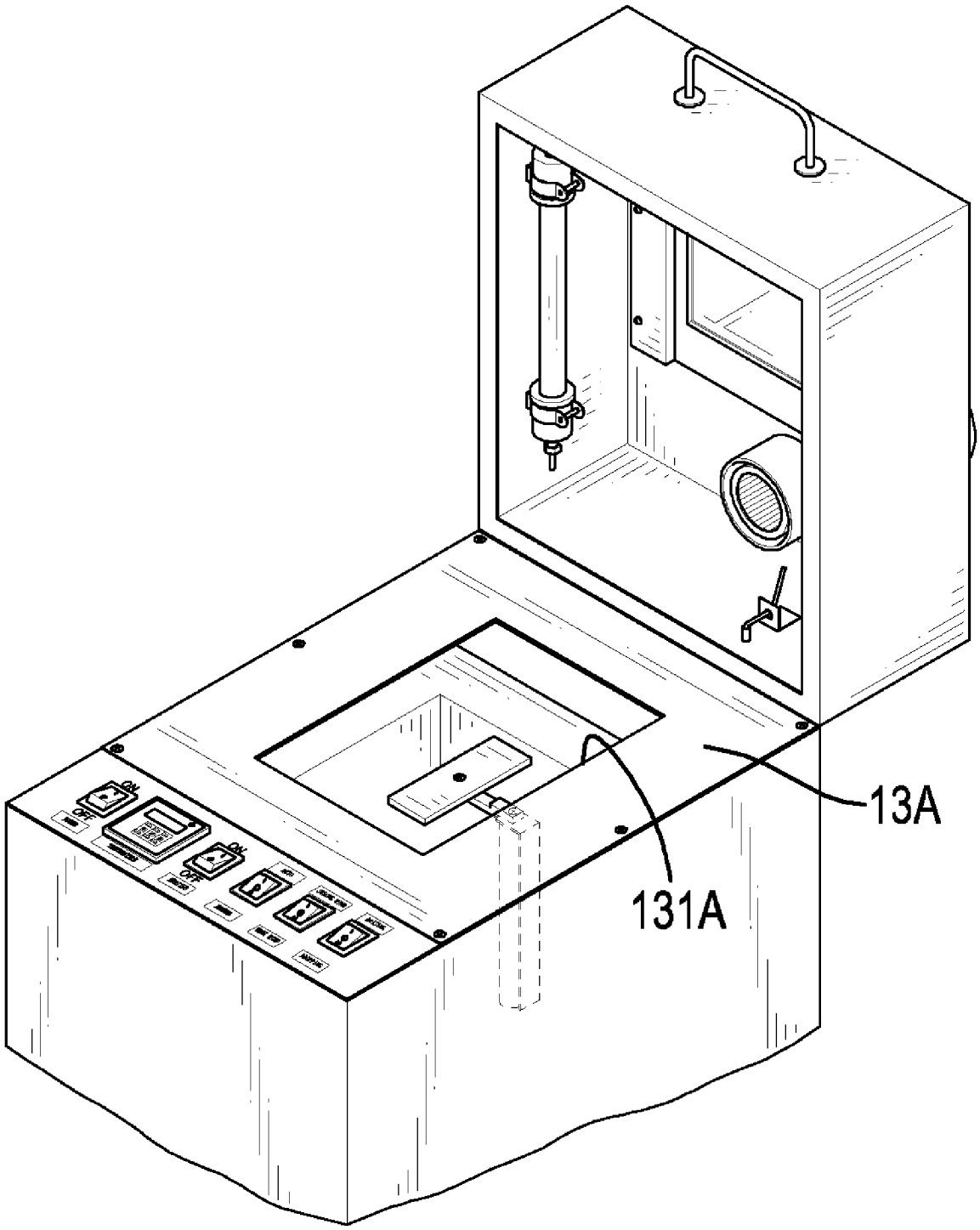
FIG. 7 is a partial perspective view of a second embodiment of a wrapping machine in accordance with the present invention.

In addition, with reference to FIG. 7, different top boards (13A) the wrapping holes (131A) in different sizes can be changeable mounted on the top of the base (11) according to the sizes of the consumer electronic products. Accordingly, the wrapping machine in accordance with the present invention can be used to wrap different sizes of the consumer electronic products.

Consequently, when using the wrapping machine in accordance with present invention to wrap the protective film (50) on the consumer electronic products, the auto-wrapping mode can provide a quick wrapping process. Furthermore, the negative pressure of the exhaust box (15) by the vacuum pump (17) moving the consumer electronic product (51) upward using the lifting platform (30) provides a preferred wrapping quality.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A wrapping machine having
a body having
a hollow base having
a top;
a bottom;
a front side;
a rear side;
two sidewalls formed with the front side and the rear side of the base;
an opening formed through the top of the base; and
a chamber formed between the front and rear sides and the sidewalls of the base and communicating with the opening;
a top board mounted on the top of the base between the front side and the rear side of the base and having a rectangular wrapping hole formed therethrough and communicating with the opening and the chamber of the base;
an upper cover pivotally connected to the top at the rear side of the base and mounted on the top board and having
a top face;
multiple sidewalls formed around the top face of the upper cover, each sidewall having
an inner surface; and
an outer surface;
a window formed through the top face of the upper cover at a position corresponding to the top board; and
a handle mounted on the outer surface of one of the sidewalls of the upper cover;
an exhaust box mounted in the chamber of the base below the top board; and
a vacuum pump mounted in the chamber of the base and having a suction pipe connected to and communicating with the exhaust box;
a heater mounted on the body and having
two heating pipes respectively mounted on the inner surfaces of two of the sidewalls of the upper cover and facing to each other;
a blower mounted on the upper cover and having
a top end mounted on the top face of the upper cover between the sidewalls of the upper cover;
a lower end mounted in the upper cover between the sidewalls above the top board; and
an air outlet formed in the lower end of the blower;
a lifting platform connected to the body and having
a lifting arm mounted on and extended upward from the exhaust box to the wrapping hole of the top board and having
a lifting shaft movably mounted in the lifting arm and having a top end; and
a linking panel connected to the top end of the lifting shaft of the lifting arm, selectively extending through the wrapping hole of the top board and having a top face; and
a lifting board mounted on the top face of the linking panel of the lifting arm; and
a controller mounted on the body and electrically connected to the heater, the lifting platform and the vacuum pump of the body.

2. The wrapping machine as claimed in claim 1, wherein
the base has an operating panel mounted on the top of the base between the top board and the front side of the base; and
the controller is mounted on the operating panel of the body.

3. The wrapping machine as claimed in claim 2, wherein
the vacuum pump has a control valve connected to the suction pipe to control the sucking rate of the vacuum pump; and
the controller has
a power switch mounted on the operating panel of the body to control the electric power to the body, the heater and the lifting platform;
a heating switch mounted on the operating panel of the body near the power switch to control the heating pipes of the heater;
a manual-auto switch mounted on the operating panel of the body adjacent to the heating switch;
a blower switch mounted on the operating panel of the body adjacent to the manual-auto switch to control the blower of the heater;
a lifting switch mounted on the operating panel of the body adjacent to the blower switch to control the lifting arm of the lifting platform;
a temperature display mounted on the operating panel of the body between the power switch and the heating switch to show the temperature between the upper cover and the top board;
a temperature sensor mounted on the inner surface of one of the sidewalls of the upper cover to detect the temperature between the upper cover and the top board; and
a controller unit mounted in the chamber of the body and electrically connected to the vacuum pump, the control valve, the power switch, the heating switch, the manual-auto switch, the blower switch, the lifting switch, the temperature display and the temperature sensor.

4. The wrapping machine as claimed in claim 3, wherein
the top board is detachably mounted on the top of the base between the front side and the rear side of the base;
each heating pipe is a quartz tube; and
the lifting arm is a pneumatic cylinder.

5. The wrapping machine as claimed in claim 4, wherein
the exhaust box has
an open top mounted around the wrapping hole of the top board; and
a closed bottom;
the suction pipe is connected to the closed bottom of the exhaust box and communicates with the open top of the exhaust box; and
the lifting arm is mounted on the closed bottom of the exhaust box and is extended upward to the open top of the exhaust box.

* * * * *